US008516932B2

(12) United States Patent
Wang

(10) Patent No.: US 8,516,932 B2
(45) Date of Patent: Aug. 27, 2013

(54) SCREWDRIVER BIT

(76) Inventor: Tzu-Chien Wang, Tainan (TW)

( * ) Notice: Subject to any disclaimer, the term of this patent is extended or adjusted under 35 U.S.C. 154(b) by 205 days.

(21) Appl. No.: 13/209,626

(22) Filed: Aug. 15, 2011

(65) Prior Publication Data

US 2013/0042727 A1 Feb. 21, 2013

(51) Int. Cl.
*B25B 23/00* (2006.01)
*B25B 15/00* (2006.01)

(52) U.S. Cl.
USPC ..... 81/436; 81/460

(58) Field of Classification Search
USPC ..... 81/436, 460, 461; D8/86
See application file for complete search history.

(56) References Cited

U.S. PATENT DOCUMENTS 5,704,261 A * 1/1998 Strauch et al. ..... 81/467
7,437,979 B1 * 10/2008 Wang ..... 81/436
2011/0283842 A1 * 11/2011 Lai ..... 81/460

* cited by examiner

*Primary Examiner* — David B Thomas
(74) *Attorney, Agent, or Firm* — Rabin & Berdo, P.C.

(57) ABSTRACT

A screwdriver bit has a shank, a connecting portion, a necking portion defined between the shank and the connecting portion, a head disposed on a distal end of the connecting portion, multiple ribs separately arranged around the connecting portion and the necking portion and multiple shear grooves respectively defined between the connecting portion and the necking portion and each shear groove is defined between two adjacent ribs. When a torsion force is applied to the screwdriver bit, a shear force formed between the necking portion and the connecting portion is concentrated on points where the ribs and the shear grooves connect with each other in a dot-like form. Therefore, the screwdriver bit has strengthened shear strength and prolonged life for use.

4 Claims, 3 Drawing Sheets

SCREWDRIVER BIT

BACKGROUND OF THE INVENTION

1. Field of the Invention

The present invention relates to a screwdriver bit, especially to a screwdriver bit that reduces torsion force and has a strengthened structure.

2. Description of the Prior Art(s)

With reference to FIG. 3, a conventional screwdriver bit comprises a handle 90 and a head 91. The handle 90 has a shank 92, a connecting portion 93, a necking surface 94 and an annular shear groove 95. The connecting portion 93 has a distal end and a cross-sectional diameter being shorter than a cross-sectional diameter of the shank 92. The necking surface 94 is formed around and between the shank 92 and the connecting portion 93. The annular shear groove 95 is formed around and between the necking surface 94 and the connecting portion 93. The head 91 is disposed on the distal end of the connecting portion 93.

A power tool or a hand tool clamps the shank 92 and drives the conventional screwdriver bit to rotate. When the screwdriver bit rotates, a torsion force is applied to the handle 90 and twists the connecting portion 93. Thus, a shear force is concentrated on and around the annular shear groove 95 and a shear plane is formed at where the annular shear groove 95 is surrounded. Consequently, the conventional screwdriver bit is twisted off easily on the annular shear groove 95 and has poor durability.

To overcome the shortcomings, the present invention provides a screwdriver bit to mitigate or obviate the aforementioned problems.

SUMMARY OF THE INVENTION

The main objective of the present invention is to provide a screwdriver bit. The screwdriver bit has a shank, a connecting portion, a necking portion defined between the shank and the connecting portion, a head disposed on a distal end of the connecting portion, multiple ribs separately arranged around the connecting portion and the necking portion and multiple shear grooves respectively defined between the connecting portion and the necking portion and each shear groove is defined between two adjacent ribs.

When a torsion force is applied to the screwdriver bit, a shear force formed between the necking portion and the connecting portion is concentrated on points where the ribs and the shear grooves connect with each other in a dot-like form. Therefore, the screwdriver bit has strengthened shear strength and prolonged life for use.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
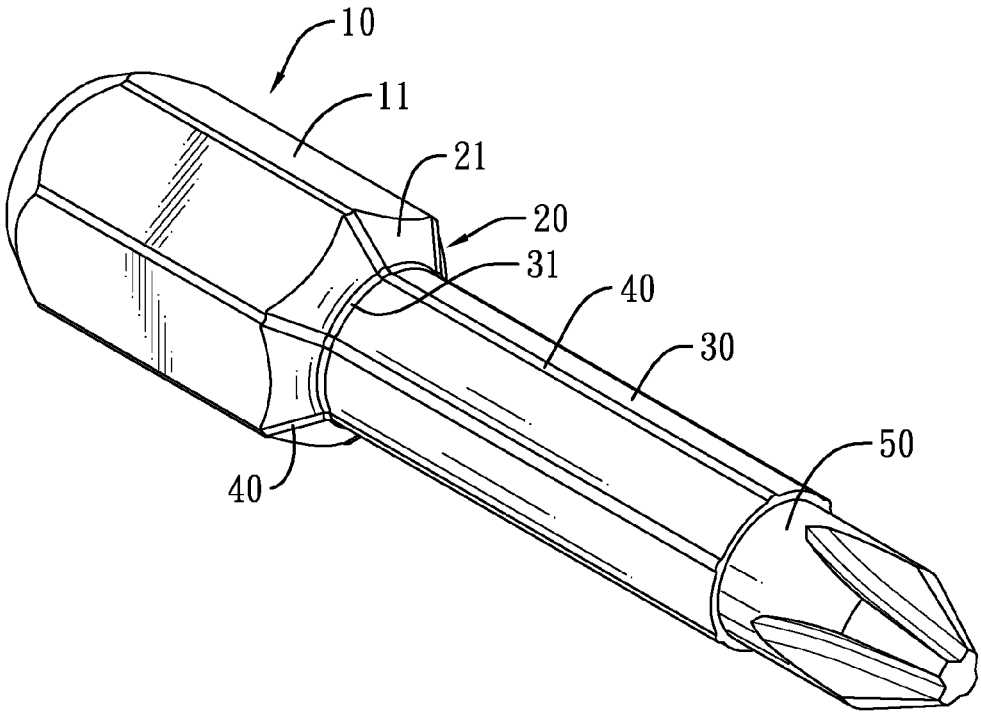
FIG. 1 is a perspective view of a screwdriver bit in accordance with the present invention.
Figure 2:
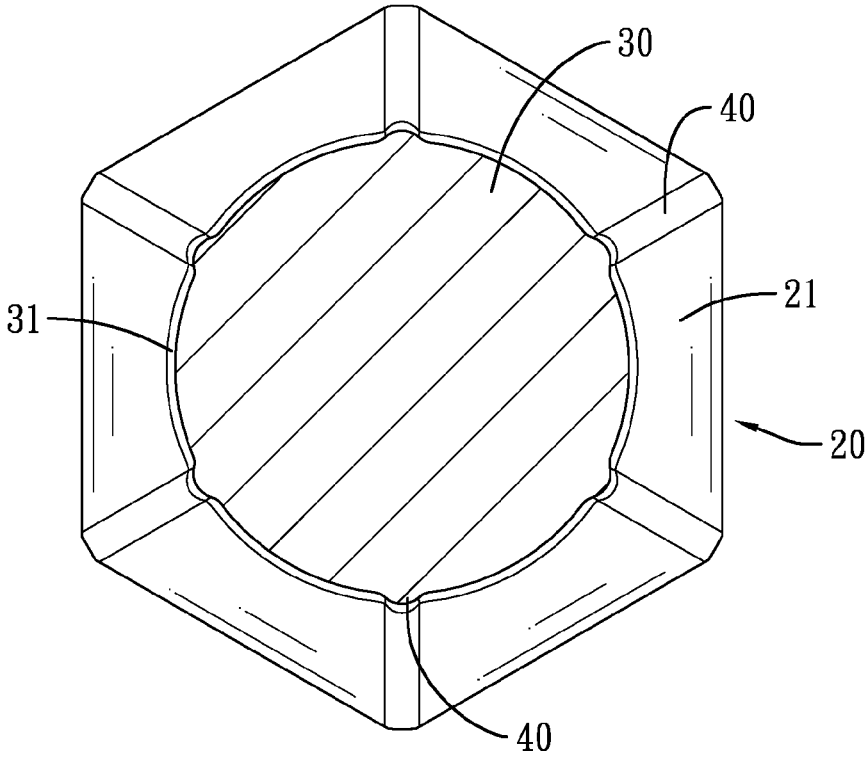
FIG. 2 is an end view in cross-section of the screwdriver bit in FIG. 1.
Figure 3:
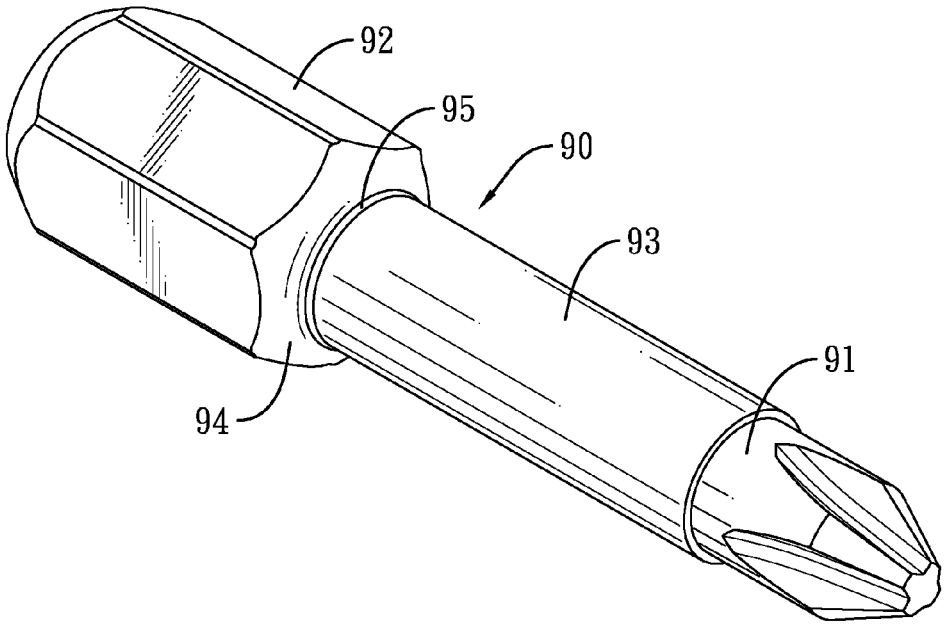
FIG. 3 PRIOR ART
FIG. 3 is a perspective view of a conventional screwdriver bit in accordance with the prior art.

With reference to FIGS. 1 and 2, a screwdriver bit in accordance with the present invention comprises a shank 10, a connecting portion 30, a necking portion 20, a head 50, multiple ribs 40 and multiple shear grooves 31.

The shank 10 has multiple clamped surfaces 11 arranged around the shank 10.

The connecting portion 30 has an outer surface and a distal end.

The necking portion 20 is defined between the shank 10 and the connecting portion 30 and has a necking surface 21. The necking surface 21 may be conical, is defined around the necking portion 20 and is tapered from the shank 10 to the connecting portion 30.

The head 50 is disposed on and axially protrudes from the distal end of the connecting portion 30 and may be cruciform, flat-bladed and the like.

The ribs 40 are axially formed on and separately arranged around the outer surface of the connecting portion 30 and the necking surface 21 of the necking portion 20.

The shear grooves 31 are defined between the connecting portion 30 and the necking portion 20 and each shear groove 31 is defined between two adjacent ribs 40.

The screwdriver bit as described has the following advantages. A power tool or a hand tool clamps the shank 10 and drives the screwdriver bit to rotate. When a torsion force is applied to the shank 10 by the power tool or the hand tool and is further transmitted to the head 50, a shear force formed between the necking portion 20 and the connecting portion 30 is concentrated on points where the ribs 40 and the shear grooves 31 connect with each other in a dot-like form instead of an annular form. Therefore, the screwdriver bit has strengthened shear strength and prolonged life for use and is not twisted off between the necking portion 20 and the connecting portion 30.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A screwdriver bit comprising a shank;

a connecting portion having an outer surface and a distal end;

a necking portion defined between the shank and the connecting portion and having a necking surface defined around the necking portion and tapered from the shank to the connecting portion;

a head disposed on and axially protruding from the distal end of the connecting portion;

multiple ribs axially formed on and separately arranged around the outer surface of the connecting portion and the necking surface of the necking portion; and multiple shear grooves respectively defined between the connecting portion and the necking portion and each shear groove defined between two adjacent ribs.

2. The screwdriver bit as claimed in claim 1, wherein the shank has multiple clamped surfaces arranged around the shank.

3. The screwdriver bit as claimed in claim 1, wherein the necking surface of the necking portion is conical.

4. The screwdriver bit as claimed in claim 2, wherein the necking surface of the necking portion is conical.

* * * * *